US010753548B2

(12) United States Patent
On et al.

(10) Patent No.: US 10,753,548 B2
(45) Date of Patent: Aug. 25, 2020

(54) FLEXIBLE FILAMENT LAMP

(71) Applicant: Dongguang Keetat Lighting Ltd., Dongguan (CN)

(72) Inventors: Hing Chiu On, Dongguan (CN); Minghu Huang, Dongguan (CN); Qiang Li, Dongguan (CN)

(73) Assignee: Dongguan Keetat Lighting Ltd., Dongguan (CN)

( * ) Notice: Subject to any disclaimer, the term of this patent is extended or adjusted under 35 U.S.C. 154(b) by 0 days.

(21) Appl. No.: 16/037,534

(22) Filed: Jul. 17, 2018

(65) Prior Publication Data

US 2019/0368667 A1 Dec. 5, 2019

(30) Foreign Application Priority Data

Jun. 5, 2018 (CN) ..... 2018 2 0866130 U

(51) Int. Cl.
*F21K 9/237* (2016.01)
*F21K 9/232* (2016.01)
*F21Y 107/00* (2016.01)

(52) U.S. Cl.
CPC ..... *F21K 9/237* (2016.08); *F21K 9/232* (2016.08); *F21Y 2107/00* (2016.08)

(58) Field of Classification Search
CPC ..... F21K 9/237
See application file for complete search history.

(56) References Cited

U.S. PATENT DOCUMENTS

| | | | | |
|---|---|---|---|---|
| 10,066,791 | B2 * | 9/2018 | Zhang | F21K 9/232 |
| 10,197,260 | B2 * | 2/2019 | Chen | F21V 19/001 |
| 10,215,343 | B2 * | 2/2019 | Haberkorn | F21K 9/232 |
| 2017/0234519 | A1 * | 8/2017 | Yeung | F21V 29/00 362/84 |
| 2018/0112832 | A1 * | 4/2018 | Wu | F21K 9/238 |

FOREIGN PATENT DOCUMENTS

| | | | | |
|---|---|---|---|---|
| KR | 2019048802 A | * | 5/2019 | F21K 9/232 |

* cited by examiner

*Primary Examiner* — Sharon E Payne
(74) *Attorney, Agent, or Firm* — Wang Law Firm, Inc.

(57) ABSTRACT

A flexible filament lamp includes a bulb shell, a spiral LED filament, a lamp cap connected to the bulb shell, a stem disposed in the bulb shell, and first and second leads disposed in the stem. Both of the first and second leads are electrically connected to the lamp cap. The stem has a metal sheet bracket with a fixing ring extended from both sides of the metal sheet bracket for fixing the spiral LED filament. The first lead is electrically connected to an end of the spiral LED filament. The second lead is electrically connected to the other end of the spiral LED filament after passing through the metal sheet bracket. The metal sheet bracket disposed on the stem is integrally formed with the fixing rings. The flexible filament lamp of this invention will not be bent easily, so as to facilitate the operation and production.

7 Claims, 10 Drawing Sheets

FLEXIBLE FILAMENT LAMP

FIELD OF INVENTION

The present invention relates to the field of lighting, in particular to a flexible filament lamp.

BACKGROUND OF INVENTION

1. Description of the Related Art

In general, a traditional spiral flexible filament lamp comprises a molybdenum filament inserted into a solid glass column, and a fixing ring mounted onto a molybdenum filament stem for fixing a spiral LED filament, but such structure has the following drawbacks: 1. Since the molybdenum filament is inserted into the solid glass column, the production process is cumbersome and the product is inconvenient to produce. 2. Since the solid glass column is inserted into the molybdenum filament by burning with fire, stress fractures may occur easily, and the molybdenum filament may be loosened easily. 3. The molybdenum filament is fine and soft, so that the filament may be deformed or bent easily, and thus making the operation inconvenient.

In view of the aforementioned drawbacks of the prior art, the inventor of the present invention based on years of experience in the related industry to conduct extensive research and experiment, and finally designed a flexible filament lamp in accordance with the present invention to overcome the drawback of the prior art.

2. Summary of the Invention

Therefore, it is a primary objective of the present invention to provide a flexible filament lamp with the features of stable structure and convenient production.

To achieve the aforementioned and other objectives, the present invention provides a flexible filament lamp, comprising: a bulb shell, spiral LED filament, a lamp cap coupled to the bulb shell, a stem disposed in the bulb shell, and a first lead and a second lead, both disposed in the stem and electrically coupled to the lamp cap; characterized in that the stem has a metal sheet bracket and a fixing ring extended separately from both sides of the metal sheet bracket for fixing the spiral LED filament; the first lead is electrically coupled to an end of the spiral LED filament; and the second lead is electrically coupled to the other end of the spiral LED filament after passing through the metal sheet bracket.

The flexible filament lamp further comprises a glass column disposed at the top of the stem, and the metal sheet bracket is fixed onto the glass column.

In the flexible filament lamp, the spiral LED filament includes a first filament and a second filament connected in parallel to each other, and the first filament and the second filament are mounted from bottom to top onto the metal sheet bracket.

In the flexible filament lamp, the first lead is electrically coupled to an end of the first filament; the second lead is electrically coupled to the bottom of the metal sheet bracket; a metal strip is extended from the middle of the metal sheet bracket; the other end of the first filament is electrically coupled to an end of the second filament and the metal strip; the first lead is extended upwardly to the top of the metal sheet bracket to form a third lead; and the third lead is electrically coupled to the other end of the second filament.

In the flexible filament lamp, an insulation sleeve is installed between the first lead and the third lead, and a slot is formed at the top of the metal sheet bracket for fixing the insulation sleeve.

In the flexible filament lamp, a fixing bar is extended from the top of the metal sheet bracket for fixing the other end of the spiral LED filament, and the bottom of the metal sheet bracket is electrically coupled to the second lead, and the fixing bar is electrically coupled to the other end of the spiral LED filament.

In the flexible filament lamp, a support frame is disposed at the top of the metal sheet bracket.

The present invention has the following beneficial effects: In the metal sheet bracket installed onto the stem in accordance with the present invention, the fixing rings are disposed on both sides of the metal sheet bracket, and the fixing rings are integrally formed with the metal sheet bracket. Compared with the conventional fixing ring formed by inserting the solid glass column into the molybdenum filament, the flexible filament lamp of this invention will not be bent easily, so as to facilitate the operation and production.

DESCRIPTION OF THE PREFERRED EMBODIMENTS

Figure 1:
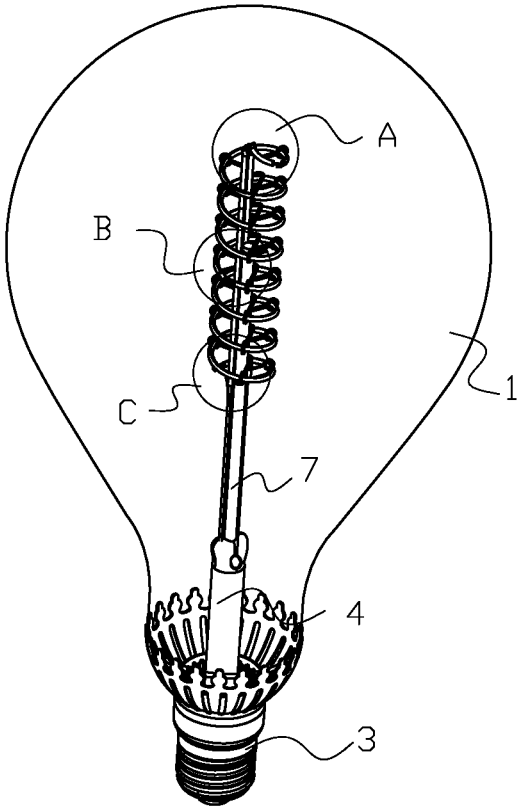
FIG. 1 is a schematic view of a first embodiment of the present invention.
Figure 2:
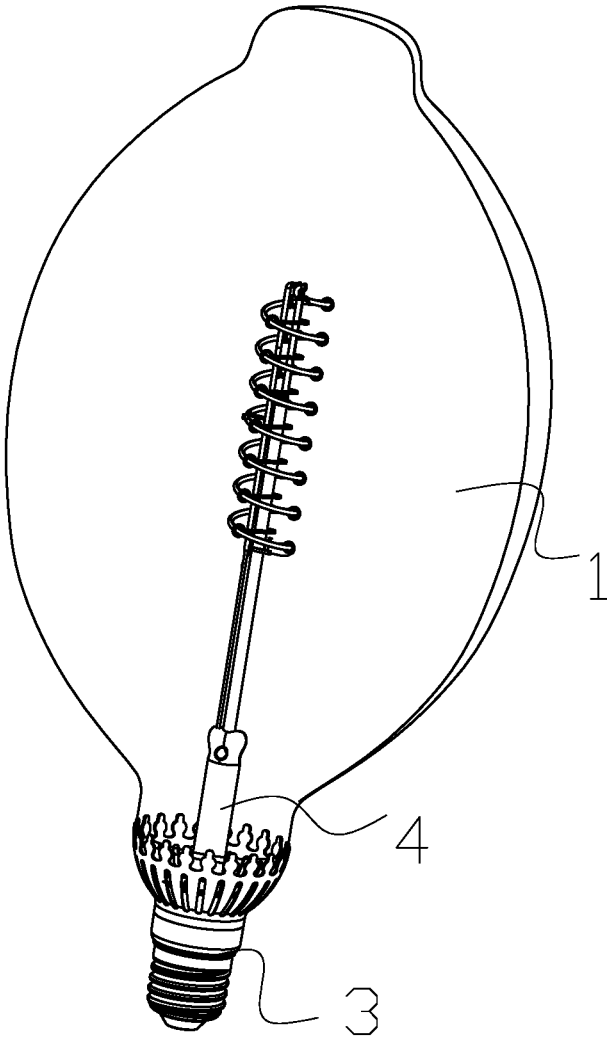
FIG. 2 is another schematic view of the first embodiment of the present invention.

To make it easier for our examiner to understand the objective, technical characteristics, structure, innovative features, and performance of the invention, we use preferred embodiments together with the attached drawings for the detailed description of the invention.

With reference to FIGS. 1 to 6 for a flexible filament lamp in accordance with the first embodiment of the present invention, the flexible filament lamp comprises a bulb shell 1, a spiral LED filament 2, a lamp cap 3 coupled to the bulb shell 1, a stem 4 disposed in the bulb shell 1, and a first lead 51 and a second lead 52, both disposed in the stem 4; both of the first lead 51 and second lead 52 are electrically coupled to the lamp cap 3; the stem 4 has a metal sheet bracket 6 disposed thereon; a fixing ring 61 is extended separately from both sides of the metal sheet bracket 6 for fixing the spiral LED filament 2; the first lead 51 is electrically coupled to an end of the spiral LED filament 2; and the second lead 52 is electrically coupled to the other end of the spiral LED filament 2 after passing through the metal sheet bracket 6.

Specifically, the metal sheet bracket 6 is mounted onto the stem 4 in accordance with this embodiment, and both sides of the metal sheet bracket 6 have the plurality of fixing rings 61, and the fixing rings 61 are integrally formed with the metal sheet bracket 6. Compared with the conventional fixing ring 61 formed by inserting the solid glass column into the molybdenum filament, the flexible filament lamp of this embodiment will not be bent easily during the production process, so as to facilitate the operation and production. In addition, the metal sheet bracket 6 is a metal piece, so that when the metal sheet bracket 6 is electrically coupled to the spiral LED filament 2, all we need is to couple the second lead 52 to the bottom of the metal sheet bracket 6, and coupled the top of the metal sheet bracket 6 to the spiral LED filament 2. The length of the second lead 52 can be reduced significantly.

In the flexible filament lamp of this embodiment, the stem 4 has a glass column 7 disposed at the top of the stem 4, and the metal sheet bracket 6 is fixed onto the glass column 7. In this embodiment, the installation of the glass column 7 increases the height of the metal sheet bracket 6 to meet the requirements for different specifications of the bulb shell 1.

In the flexible filament lamp of this embodiment, the spiral LED filament 2 includes a first filament 21 and a second filament 22 coupled in parallel with each other, and the first filament 21 and the second filament 22 are mounted onto the metal sheet bracket 6 from bottom to top. The installation of the first filament 21 and the second filament 22 increases the brightness of the filament lamp, and the two filaments connected in parallel with each other can work independently.

In the flexible filament lamp of this embodiment, the first lead 51 is electrically coupled to an end of the first filament 21; the second lead 52 is electrically coupled to the bottom of the metal sheet bracket 6; a metal strip 62 is extended from the middle of the metal sheet bracket 6; the other end of the first filament 21 is electrically coupled to an end of the second filament 22 and the metal strip 62; the first lead 51 is extended upwardly to the top of the metal sheet bracket 6 to form a third lead 53; and the third lead 53 is electrically coupled to the other end of the second filament 22. With the aforementioned arrangements, the first filament 21 and the second filament 22 of this embodiment are coupled in parallel to each other.

In the flexible filament lamp of this embodiment, an insulation sleeve 8 is installed between the first lead 51 and the third lead 53; and a slot 63 is formed at the top of the metal sheet bracket 6 for fixing the insulation sleeve 8. With the design of the slot 63, the insulation sleeve 8 can be fixed into a position conveniently to prevent it from swinging or moving.

With reference to FIGS. 6 to 9 for the second embodiment of the present invention, this embodiment is substantially the same as the first embodiment, except that this embodiment does not require any glass column 7, and there is only one spiral LED filament 2. In the flexible filament lamp of this embodiment, a fixing bar 64 is extended from the top of the metal sheet bracket 6 for fixing the other end of the spiral LED filament 2; the bottom of the metal sheet bracket 6 is electrically coupled to the second lead 52; and the fixing bar 64 is electrically coupled to the other end of the spiral LED filament 2. The fixing bar 64 disposed at the top of the metal sheet bracket 6 can further fix the spiral LED filament 2 into a position securely to prevent it from swinging or moving.

Figure 3:
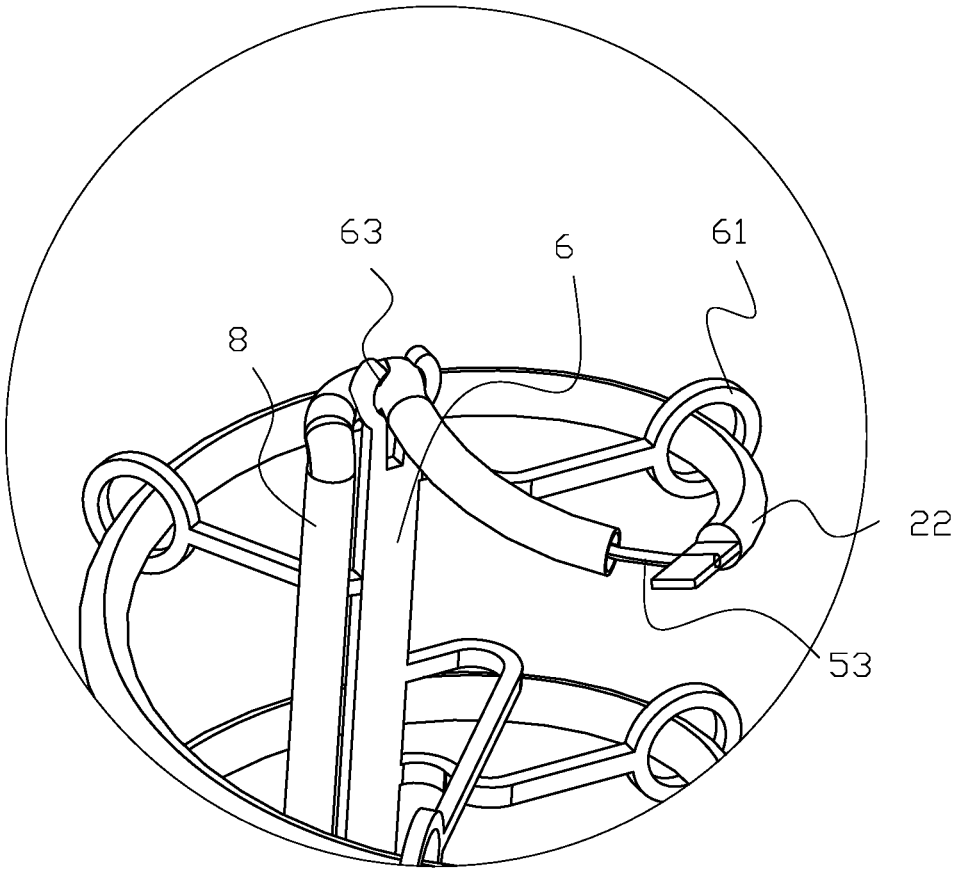
FIG. 3 is a partial blowup view of Section A of FIG. 1.
Figure 4:
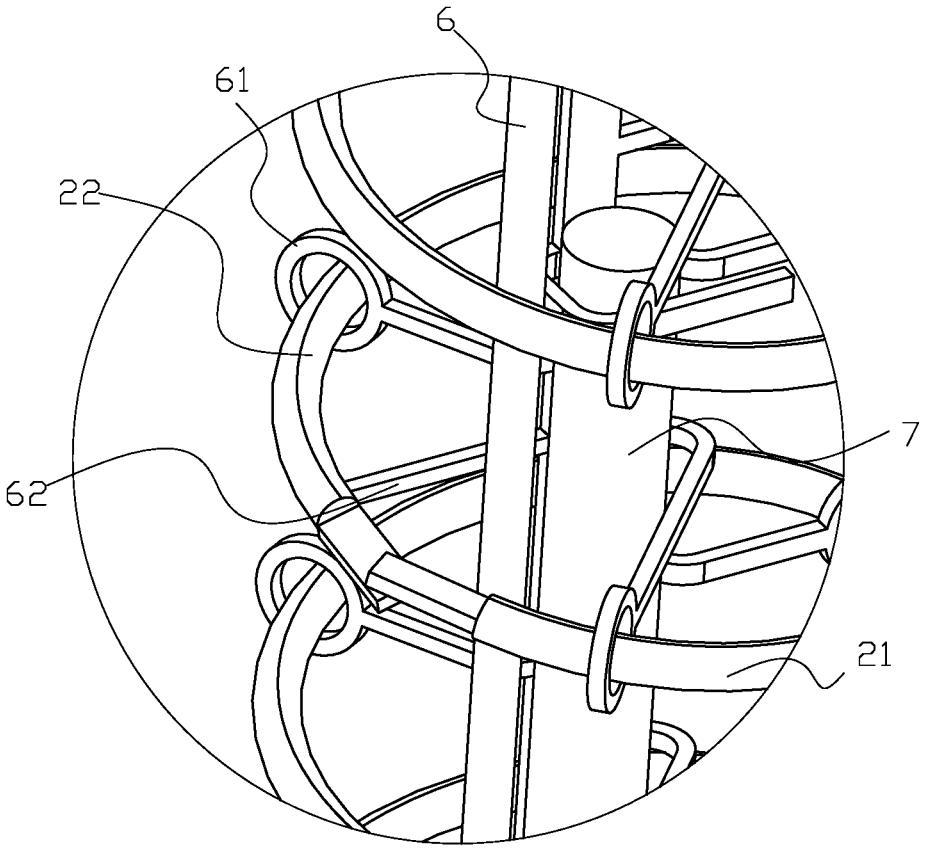
FIG. 4 is a partial blowup view of Section B of FIG. 1.
Figure 5:
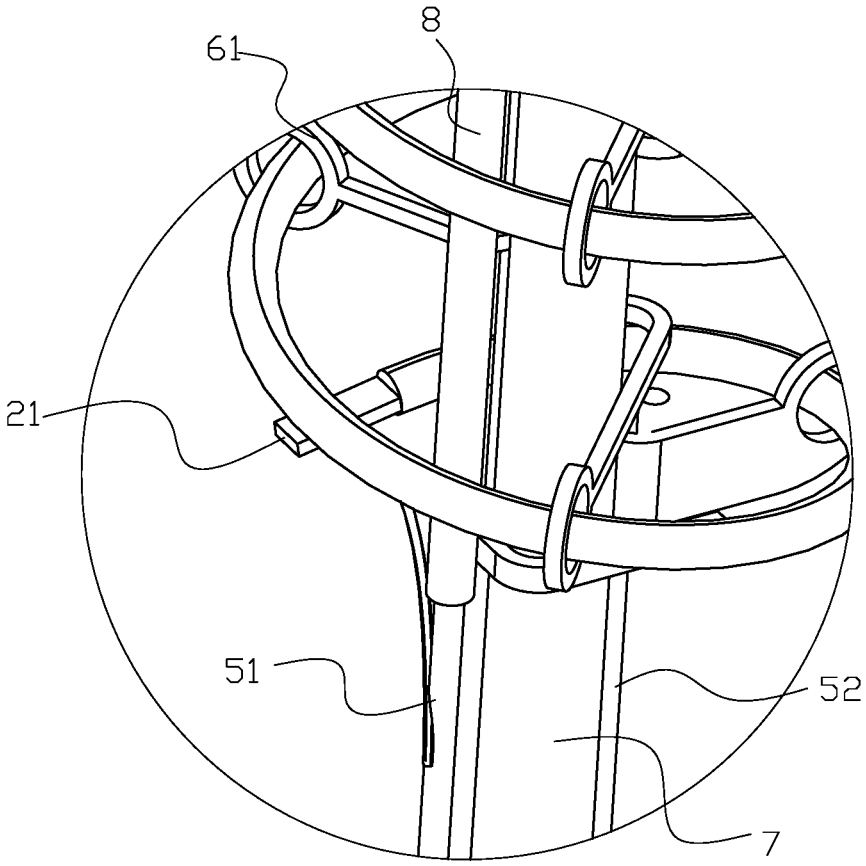
FIG. 5 is a partial blowup view of Section C of FIG. 1.
Figure 6:
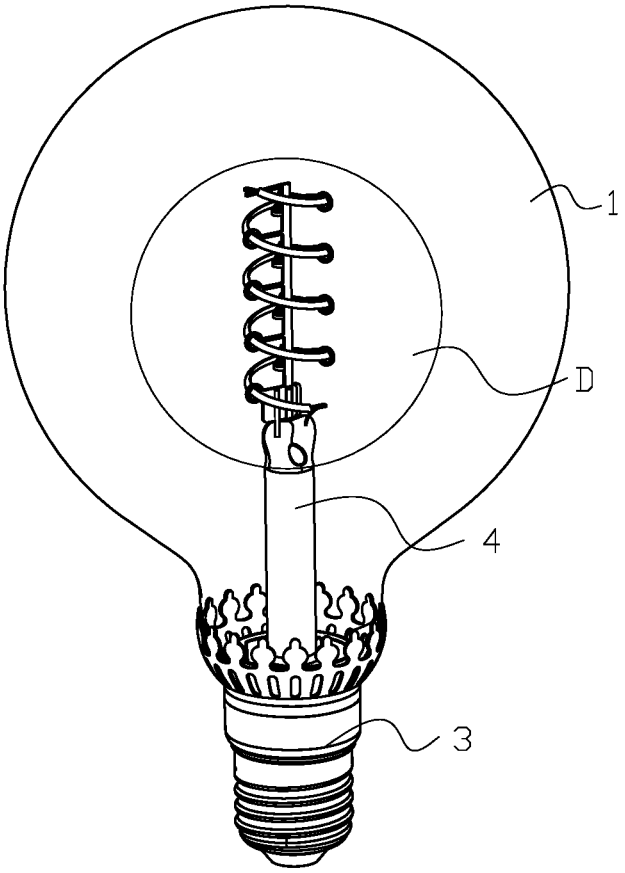
FIG. 6 is a schematic view of a second embodiment of the present invention.
Figure 7:
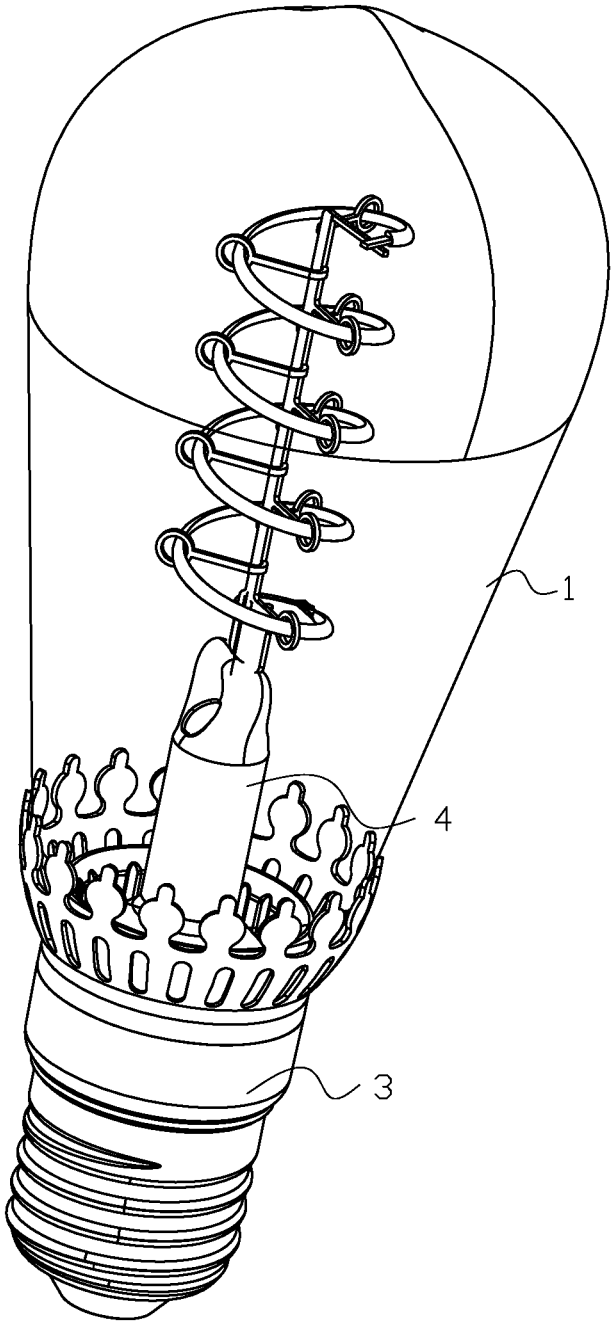
FIG. 7 is another schematic view of the second embodiment of the present invention.
Figure 8:
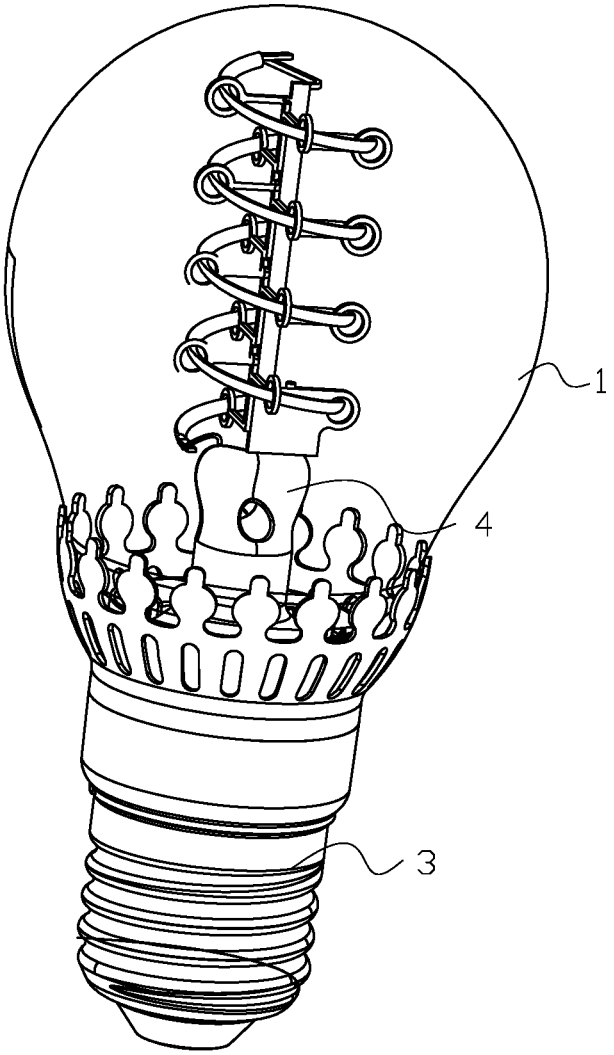
FIG. 8 is a further schematic view of the second embodiment of the present invention.
Figure 9:
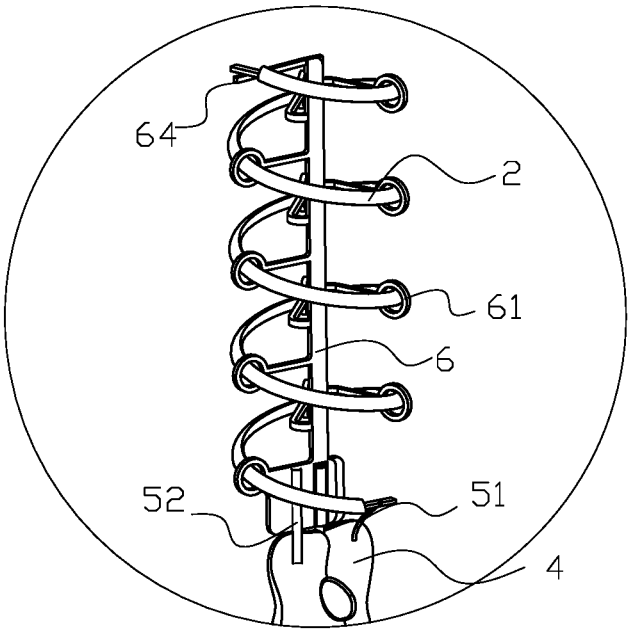
FIG. 9 is a partial blowup view of Section D of FIG. 6.
Figure 10:
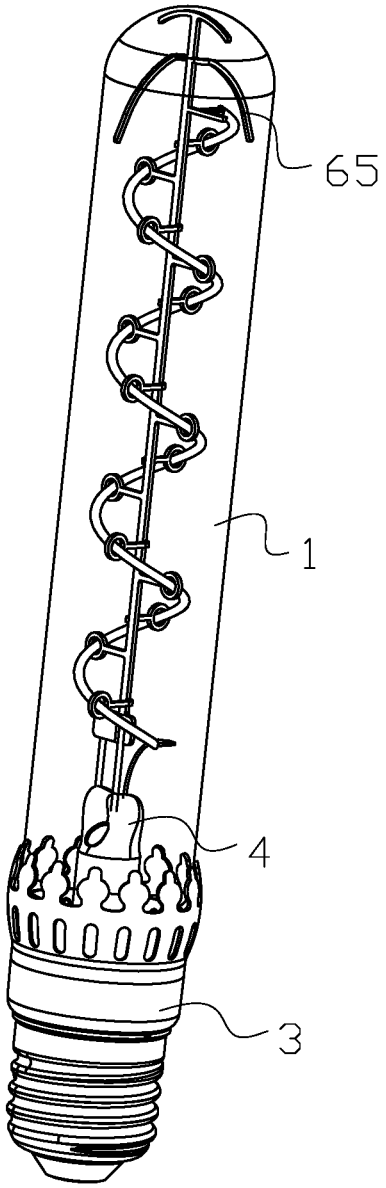
FIG. 10 is a schematic view of a third embodiment of the present invention.

With reference to FIG. 3 for the third embodiment of the present invention, this embodiment is substantially the same as the second embodiment, except that the flexible filament lamp of this embodiment further comprises a support frame 65 disposed at the top of the metal sheet bracket 6. For the bulb shell 1, the support frame 65 of this embodiment increases the supporting force between the metal sheet bracket 6 and the bulb shell 1 to secure the metal sheet bracket 6, wherein the support frame 65 has a cross- section in an arc shape.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flexible filament lamp, comprising:
a bulb shell,
a spiral LED filament,
a lamp cap coupled to the bulb shell,
a stem disposed in the bulb shell and
a first lead and a second lead, both disposed in the stem;
both of the first lead and second lead being electrically coupled to the lamp cap; characterized in that
the stem has a sheet metal bracket installed thereto;
a plurality of fixing rings are extended separately from both sides of the sheet metal bracket and provided for the spiral LED filament passing therethrough, each fixing ring being attached to the sheet metal bracket through a single bar;
the first lead is electrically coupled to an end of the spiral LED filament; and
the second lead is electrically coupled to the other end of the spiral LED filament after passing through the sheet metal bracket.

2. The flexible filament lamp of claim 1, wherein the stem has a glass column disposed at the top of the stem; and the sheet metal bracket is fixed onto the glass column.

3. The flexible filament lamp of claim 2, wherein the spiral LED filament includes a first filament and a second filament connected in parallel with each other; and
the first filament and the second filament are mounted from bottom to top onto the sheet metal bracket.

4. The flexible filament lamp of claim 3, wherein the first lead is electrically coupled to an end of the first filament; the second lead is electrically coupled to the bottom of the sheet metal bracket; a metal strip is extended from the middle of the sheet metal bracket; the other end of the first filament is electrically coupled to an end of the second filament and the metal strip; the first lead is extended upwardly to the top of the sheet metal bracket to form a third lead; and the third lead is electrically coupled to the other end of the second filament.

5. The flexible filament lamp of claim 4, wherein the first lead and the third lead have an insulation sleeve installed therebetween; and a slot is formed at the top of the sheet metal bracket for fixing the insulation sleeve.

6. The flexible filament lamp of claim 1, wherein the sheet metal bracket has a fixing bar extended from the top of the sheet metal bracket for fixing the other end of the spiral LED filament; the bottom of the sheet metal bracket is electrically coupled to the second lead; and the fixing bar is electrically coupled to the other end of the spiral LED filament.

7. The flexible filament lamp of claim 6, wherein the sheet metal bracket has a support frame disposed at the top of the sheet metal bracket.

* * * * *